US010597960B2

(12) United States Patent
Solem

(10) Patent No.: US 10,597,960 B2
(45) Date of Patent: Mar. 24, 2020

(54) ACTIVATION MECHANISM FOR A DOWNHOLE TOOL AND A METHOD THEREOF

(71) Applicant: Advancetech ApS, Gredstedbro (DK)

(72) Inventor: Sigurd Solem, Gredstedbro (DK)

(73) Assignee: ADVANCETECH APS, Gredstedbro (DK)

( * ) Notice: Subject to any disclaimer, the term of this patent is extended or adjusted under 35 U.S.C. 154(b) by 61 days.

(21) Appl. No.: 15/124,850

(22) PCT Filed: Dec. 18, 2014

(86) PCT No.: PCT/DK2014/050441
§ 371 (c)(1),
(2) Date: Sep. 9, 2016

(87) PCT Pub. No.: WO2015/135548
PCT Pub. Date: Sep. 17, 2015

(65) Prior Publication Data

US 2017/0016292 A1 Jan. 19, 2017

(30) Foreign Application Priority Data

Mar. 14, 2014 (DK) ..... 2014 70125

(51) Int. Cl.

| | |
|---|---|
| ***E21B 44/00*** | (2006.01) |
| ***E21B 23/00*** | (2006.01) |
| ***E21B 47/00*** | (2012.01) |
| ***E21B 34/10*** | (2006.01) |
| ***E21B 47/18*** | (2012.01) |
| ***E21B 21/08*** | (2006.01) |
| ***E21B 47/06*** | (2012.01) |
| *E21B 7/06* | (2006.01) |

(Continued)

(52) U.S. Cl.
CPC ..... *E21B 23/00* (2013.01); *E21B 21/08* (2013.01); *E21B 34/102* (2013.01); *E21B 44/00* (2013.01);

(Continued)

(58) Field of Classification Search
CPC ..... E21B 44/00; E21B 44/005
See application file for complete search history.

(56) References Cited

U.S. PATENT DOCUMENTS 4,013,945 A * 3/1977 Grosso ..... E21B 47/022 318/648
5,242,020 A * 9/1993 Cobern ..... E21B 17/1021 166/254.2

(Continued)

FOREIGN PATENT DOCUMENTS

CA 2601786 A1 10/2006
CN 103097645 A 5/2013

(Continued)

*Primary Examiner* — William D Hutton, Jr.
*Assistant Examiner* — Steven A MacDonald
(74) *Attorney, Agent, or Firm* — David S. Safran; Roberts Calderon Safran & Cole, P.C.

(57) ABSTRACT

An activation method and a mechanism in which a pressure or flow sensor senses the pressure or flow rate of the treatment fluid being pumped through the drill string. A controller powered by a power source monitors the sensed pressure or flow rate within a first time window and via a suitable activator activates a first downhole tool or operation mode thereof if the sensed pressure or flow rate is stable with that time window. The controller monitors the sensed pressure or flow rate within a second time window and activates a second downhole tool or second operation mode of the first downhole tool if the sensed pressure or flow rate is stable with that time window. In one embodiment, the sensed pressure is combined with a rotation sensor sensing the rotation of the drill string. The controller logs the starting time for the pumping and the rotation.

10 Claims, 4 Drawing Sheets

(51) Int. Cl.

| | |
|---|---|
| *E21B 10/26* | (2006.01) |
| *E21B 17/10* | (2006.01) |
| *E21B 21/10* | (2006.01) |
| *E21B 23/06* | (2006.01) |
| *E21B 33/12* | (2006.01) |
| *E21B 34/06* | (2006.01) |
| *E21B 43/04* | (2006.01) |
| *E21B 34/00* | (2006.01) |

(52) U.S. Cl.

CPC ..... *E21B 47/00* (2013.01); *E21B 47/06* (2013.01); *E21B 47/18* (2013.01); *E21B 7/061* (2013.01); *E21B 10/26* (2013.01); *E21B 17/1078* (2013.01); *E21B 21/10* (2013.01); *E21B 23/06* (2013.01); *E21B 33/12* (2013.01); *E21B 34/06* (2013.01); *E21B 43/04* (2013.01); *E21B 2034/007* (2013.01)

(56) References Cited

U.S. PATENT DOCUMENTS 5,273,112 A * 12/1993 Schultz ..... E21B 34/16
166/250.07
5,355,960 A * 10/1994 Schultz ..... E21B 34/102
166/319
5,941,323 A * 8/1999 Warren ..... E21B 7/062
175/74
6,273,187 B1 8/2001 Voisin, Jr. et al.
6,543,532 B2 4/2003 Estep et al.
7,510,001 B2 3/2009 Spring et al.
8,240,376 B2 8/2012 Gordon et al.
8,286,717 B2 10/2012 Giroux et al.
8,528,668 B2 9/2013 Rasheed
9,103,180 B2 * 8/2015 Roders ..... E21B 21/103
2010/0018714 A1 1/2010 Merlau et al.
2013/0062124 A1 * 3/2013 Roders ..... E21B 21/103
175/46

FOREIGN PATENT DOCUMENTS

| | | | |
|---|---|---|---|
| CN | 103097653 | A | 5/2013 |
| EP | 0 604 155 | A1 | 6/1994 |
| GB | 2 403 488 | A | 1/2005 |
| GB | 2431674 | A | 5/2007 |
| WO | 2005/113936 | A1 | 12/2005 |
| WO | 2006/105033 | A1 | 10/2006 |
| WO | 2007049046 | A1 | 5/2007 |
| WO | 2008/005289 | A2 | 1/2008 |
| WO | 2010/011461 | A1 | 1/2010 |

* cited by examiner

ACTIVATION MECHANISM FOR A DOWNHOLE TOOL AND A METHOD THEREOF

BACKGROUND OF THE INVENTION

Field of the Invention

The present invention relates to a method for activating a downhole tool of a drill string, comprising:

- sensing at least one parameter, e.g., the pressure or flow rate, of a treatment fluid, e.g., drilling fluid, being pumped through the drill string via an external pump system using at least one sensor;
- applying at least a first time window to the sensed signal from the sensor and analysing the sensed signal in a controller;
- activating at least a first downhole tool, wherein the downhole performs at least a first mode of operation upon activation,
- wherein the controller monitors the sensed parameter within the first time window and determines whether the sensed parameter remains stable relative to at least a first threshold value within the first time window or not, and activates the downhole tool if the sensed parameter is stable within the first time window.

The present invention finally relates to an activation mechanism for activating a downhole tool of a drill string, comprising:

- at least one sensor configured to sense at least one parameter, e.g., a pressure or flow rate, of a treatment fluid, e.g., drilling fluid, being pumped through the drill string via an external pump system;
- a controller connected to the sensor and configured to analyse the sensed signal of the sensor, wherein the controller is configured to apply at least one predetermined time window to the sensed signal;
- means for activating the downhole tool, wherein the downhole is configured to perform at least one mode of operation upon activation.

Description of Related Art

Today, there is a need for selectively activating various downhole tools in a drill string, such as circulating subs, under-reamers and other types of downhole tools. It is known to activate the downhole tool mechanically by means of balls being dropped into the circulating fluid, e.g., the drilling mud, at the surface of the borehole. The ball is caught by a receiving arm or cavity in the downhole tool and activates the downhole tool due to the increase in fluid pressure above the ball. Another way to activate the downhole tool is to drop a radio frequency identification tag (RFID tag) into the circulating fluid where a RF receiver in the downhole tool detects the presence of the RFID tag and a controller in the downhole tool activates the downhole tool based on the RF signal from the tag. Any downhole tools located above the selected downhole tool need to have a through hole allowing the ball to pass through. Various sizes of balls are used to activate and deactivate the downhole tool, meaning that the diameter of the trough hole has to match the diameter of the largest ball intended to pass through the downhole tool. The use of balls only allows for a limited number of activations or deactivations before having to replace the downhole tool. There is a risk that the ball blocks the circulation of the fluid thereby allowing the pressure in the fluid above the ball to increase. This increase in pressure could damage parts of the downhole tool or even parts of the operation equipment located at the ground level.

An exemplary solution thereof is disclosed in U.S. Pat. No. 9,212,592 B2 in which a circulating sub is activated by means of an active or passive RFID tag being dropped into the circulating mud. An RF receiver in the sub detects the presence of the RFID tag and a controller activates the desired function based on the detected RF signal. Both the use of balls or RFID tags presents a slow and time consuming process, since the ball or RFID tag first has to be pumped via the fluid from the surface level to the selected downhole tool. The ball or RFID tag must have a durable structure so that it does not break or otherwise becomes inoperable before reaching the selected downhole tool.

Another method for activating the downhole tool is to use the operation pressure or flow rate of the circulating fluid as a downhole link to communicate with the downhole tool. Such a solution is disclosed in U.S. Pat. No. 9,212,592 B2 which uses a pulse modulator (a mud pulser) to generate pressure pulses in the mud or an electromagnetic pulse generator to transfer data between the circulating sub and a controller located at the surface. In another embodiment of U.S. Pat. No. 9,212,592 B2, the controller modulates the flow rate or rotation speed of the mud pump located at the surface level which generates flow pulses in the mud. The circulating sub comprises a flow switch or flow meter to detect these flow pulses which are used by the controller in the sub to activate the selected function. An under-reamer activated by mud pulses is disclosed in U.S. Pat. No. 8,528,668 B2 where a mud pulser unit connected to the under-reamer is used to communicate with the equipment at the surface. The use of pressure or flow pulses provides a very complex downlink which requires the sub to detect a pulse having a certain amplitude, frequency, or shape. These solutions are sensitive to any disturbing factors, such as the use of compressible gases in the mud, and often interrupt the drilling process reducing the operation time. Electromagnetic (EM) pulses can be used instead of mud or flow pulses to activate the downhole tool; however, EM pulses are not suitable for very long drill string and are sensible to certain types of underground formations.

U.S. Pat. No. 6,543,532 B2 discloses a circulating sub having an electric motor activated by means of an electrical cable extending through the drill string. In boreholes, typically more than two kilometers deep, the voltage drop over the electrical cable, and changes in the characteristics of the cable becomes a problem. Furthermore, the electrical isolation of the cable is likely to get damaged or ruptured causing a failure in the communication.

Yet another solution is to activate the downhole tool by using indexing mechanisms where the downhole tool is activated by starting and stopping the pumps at the surface in a sequential order. The downhole tool is typically started when the pumps are started the first time; the pumps are then stopped and started again which causes the downhole tool to be deactivated. This solution presents a slow and time consuming process that reduces the operation time due to the repetitive starting and stopping of the pumps.

U.S. Pat. No. 9,103,180 B2 discloses a downhole tool having a bypass module for bypassing a part of the circulating drilling mud. A controller monitors the rotation speed of the drill string and either the flow rate or differential pressure within a given time period. The controller activates the bypass module when it is determined that the rotation speed and the flow rate or differential pressure are above a threshold level.

European Patent Application EP 0604155 A1 discloses a downhole valve unit comprising a pressure sensor connected to a controller which monitors the pressure changes of the drilling fluid passing through the valve unit to detect command signals transmitted through the drilling fluid. The valve unit is activated by increasing the pressure of the drilling fluid to a pressure range of 1000 psi to 1500 psi above the hydrostatic pressure level where the command signals are detected as pressure changes between the lower and upper limits. Once activated, the pressure of the drilling fluid is reduced back to the hydrostatic pressure level.

U.S. Pat. No. 8,240,376 B2 discloses an activation mechanism for a downhole tool comprising a pressure sensor connected to a controller which monitors the pressure level in the drilling fluid. The pressure of the drilling fluid is increased to the normal operating level and the controller then monitors the rate of the pressure change relative to a reference value. The downhole tool is then activated if the controller detects that the rate of change is below the threshold and the pressure remains within a pre-set range within a pre-set time window.

International Patent Application Publication WO 2006/105033 A1 discloses an activation method for a downhole tool using a downhole link. A controller in the downhole tool uses a pressure sensor to detect command signals transmitted in the drilling fluid. The command signal has a predetermined duration, amplitude and frequency.

There is a need for providing an improved method that allows for a fast and accurate activation of the downhole tool without the use of a ball or RFID tag or a complicated downhole link.

SUMMARY OF THE INVENTION

An object of this invention is to provide an activation method that overcomes the drawbacks of the prior art without the use of balls or RFID tags.

Another object of this invention is to provide an activation method that allows for a fast and accurate activation of a downhole tool.

A further object of this invention is to provide an activation mechanism capable of activating multiple downhole tools.

Yet another object of the invention is to provide an activation mechanism capable of being combined with a MWD, LWD or RSS system without interfering with the pressure or flow pulses used in the downhole communication link.

The objects of the invention are achieved by an activation method in which the sensed parameter is increased to a predetermined operating level after the selected operation mode or downhole tool is activated.

This provides an activation method that allows for a fast and accurate activation of the downhole tool located in the borehole. The downhole tool may be activated by simply measuring the pressure, flow rate or any other parameter of the treatment fluid being pumped through the drill string and circulated back up through the annulus between the drill string and the sidewall of the borehole. The term "treatment fluid" is defined as any type of suitable fluid or any combinations thereof, for use in a borehole during drilling, completion, servicing, work-over or any other type of process. This eliminates the need for any activation balls or RFID tags or electronic cables. A detection of a stable level of the sensed parameter allows a simpler and less complex activation process compared to the downhole link systems using mud or flow pulses. The present invention is particularly suitable for, but not limited to, measure-while-drilling (MWD), logging-while-drilling (LWD) and rotary steerable system (RSS) applications.

The term "stable" is defined by a threshold level or band having an upper and lower limit value centered relative to the threshold value where the sensed parameter remains within the upper and lower limit values.

The downhole tool may be any type of circulating subs, under-reamers, stabilizers, packers, whipstock, sleeves, valves, gravel packs or any other type of downhole tool used in a borehole. The downhole tool may form part of a larger bottom hole assembly (BHA) connected to a drill pipe. The activation mechanism may be a standalone unit connected to the downhole tool or integrated into the downhole tool.

One or more pressure sensors may be used to sense the pressure or the pressure differential of the treatment fluid passing through the downhole tool. Alternatively or additionally, one or more flow sensors may be used to sense the flow rate or velocity of the treatment fluid. The sensed signals may be pre-processed, e.g., filtered and amplified, before being processed in the controller. This allows for a simpler and more reliable activation method compared to the use of mud pulses.

In a simple embodiment, the controller monitors the sensed pressure and/or flow rate of the pumped treatment fluid within a predetermined time window. The time window may be selected on the operating flow rate, operating pressure or dimensions of the borehole. The controller compares the sensed signal to a predetermined threshold value defining an action level for the downhole tool. The threshold value may be selected based on the desired operating pressure or flow rate. The controller determines whether the sensed signal remains within the upper and lower limits of a threshold level located around the threshold value. The upper and lower limits may be determined based on the threshold value and/or the tolerance of the pumping system. If the sensed signal remains stable within the time window, then the controller activates the downhole tool or one or more activation elements located in the activation mechanism.

The operation of the downhole tool is stopped and reset by switching the pump system off or by reducing the pressure and/or flow rate below a reset threshold value. The activation mechanism may enter a standby mode after activating the downhole tool or when the pressure and/or flow rate is reduced below the reset threshold value.

According to one embodiment, at least a second time window is applied to the sensed signal prior to increasing the sensed parameter to the predetermined operating level, and the controller further determines whether the sensed parameter remains stable relative to a second threshold value within the second time window or not.

This allows the controller to determine which operation mode of a particular downhole tool should be activated. The controller may additionally or alternatively determine which of the downhole tools should be activated. In this configuration, the controller further monitors the sensed signal within a second time window, e.g., having the same length as the first time window. If the sensed signal remains stable within the second time window, then a second operation mode of the particular downhole tool or a second downhole tool is activated.

The controller may be configured to detect a temporary drop or reduction in the pressure and/or flow rate after the first downhole tool or operation mode has been activated. The drop or reduction may have a predetermined amplitude and/or length (time period). This allows the controller to verify that the selected downhole tool or operation mode has been activated. The controller may start the second time window after this temporary drop or reduction has been detected or after the pressure and/or flow rate has been increased to the second threshold value or lower threshold limit thereof.

According to one embodiment, the controller further activates at least a second operation mode of the first downhole tool or at least a second downhole tool if the sensed parameter is stable within the second time window.

In this configuration, the first downhole tool is activated as described above. The controller then monitors the sensed signal within a second time window, e.g., having the same length as the first time window. If the sensed signal remains stable relative to the second activation level within the second time window, then a second downhole tool or operation mode is activated. The activation process is repeated for a third downhole tool or operation mode, and so forth. This provides a simple and easy activation method for selectively activating a downhole tool having multiple operation modes, e.g., an adjustable stabiliser, valve or sleeve. This also enables for a selective activation of a selected downhole tool within a group of downhole tools. This configuration allows a desired operation mode or downhole tool to be selected without having to send commands to the downhole tool using mud or flow pulses.

The second threshold value for the second operation mode or downhole tool may be greater than the first threshold value. The upper and lower limits for the second threshold level may be the same as those of the first threshold level. The downhole tools may be arranged so that the downhole tool having the lowest activation level is located closest to the surface while the downhole tool having the highest activation level is located closest to the bottom of the borehole. This allows for a more optimum activation process as it allows the pressure and/or flow rate of the treatment to be increased towards the operating pressure and/or flow rate without any significant fluctuations. The second threshold value for the second operation mode or downhole tool may instead be lower than the first threshold value. This eliminates the need for compensating for the temporary drop or reduction caused by the activation of the previous downhole tool or operation mode. In this configuration, the second or third time window may be started when the sensed parameter reaches the threshold value or upper threshold limit for that activation level. If the sensed parameter is increased above the first activation level, then the activation of any further operation modes or downhole tools may be terminated.

This configuration allows the activation mechanism to activate any downhole tool or operation mode by bypassing the activation levels of the other downhole tools or operation modes. The pressure and/or flow rate of the sensed parameter may be increased directly to the desired activation level. If the pressure and/or flow rate of the sensed parameter is increased or reduced before the respective time window has lapsed, e.g., the sensed signal passes the upper or limit value, then the respective operation mode or downhole tool is not activated.

According to a special embodiment, the second threshold value is the same as the first threshold value.

This allows the multiple operation modes or downhole tools to be activated according to a sequential order. In this configuration, the activation levels for the different operation modes or downhole tools are the same. The desired operation mode or downhole tool is selectively activated by maintaining the pressure and/or flow rate at the same level for more than one time window.

In this configuration, the controller determines whether the sensed signal remains stable relative to the first activation level within the second time window or not. If the sensed parameter is still stable relative to the first activation level, then the controller activates the second operation mode or downhole tool. If more than two operation modes or downhole tools are present, then the controller further determines whether the sensed signal remains stable relative to the first activation level within the third time window, and so forth. The temporary drop or reduction in the pressure and/or flow rate may be used to determine which of the operation modes or downhole tools is presently activated.

This configuration provides an activation method that does not interfere with the communication range of a MWD, LWD or RSS system, since the activation is done before the operating pressure and/or flow rate is reached. This is particularly suitable for drilling applications in which mud or flow pulses are used. The activation levels for the operation modes or downhole tools may be selected between 10 to 90% of the desired operating pressure and/or flow rate. The operating flow rate may be selected between 1.000 to 1.500 L/min. The operating pressure may be selected according to the desired application, e.g., between 10 and 100 bar. The time windows may be selected between 1 minute and 10 minutes, e.g., between 3 and 5 minutes. The upper and lower threshold values may be selected between ±1 to 10% of the selected activation level or the operating level.

According to one embodiment, at least one battery unit drives the electronic components of the activation mechanism.

The present invention may be powered by a replaceable and/or rechargeable battery unit. A transducer unit may be configured to transfer at least some of the kinetic energy of the treatment fluid passing through the drill string into an electrical energy, e.g., power, which may be stored in the battery unit.

The pressure and/or flow sensors may be used to detect whether the pump system located at the surface level is switched on or off, e.g., by comparing it to another activation threshold value. This threshold value may be defined by the hydrostatic pressure for the depth at which the downhole tool is located. This allows the activation mechanism to enter a standby mode when the pump system is switched off and thereby reducing the power consumption. The activation mechanism may enter a normal mode once the pressure and/or flow rate exceeds this threshold value. Alternatively a vibration or rotation sensor connected to the controller may be used to detect whether the pump system is switched on or off.

According to one embodiment, the method further comprises the steps of:

- sensing at least a second parameter, e.g., a rotation, of drill string, using at least a second sensor;
- wherein the controller monitors the sensed parameter and the second parameter and determines a first starting time for the sensed parameter and a second starting time for the second parameter.

This also provides a fast and accurate activation method without the use of any activation balls or RFID tags. This configuration allows the downhole tool to be activated by monitoring the pressure or flow rate of the treatment fluid being pumped through the drill string as well as the rotation of the drill string. The controller is configured to monitor the two parameters and log the time at which the pumping and the rotation is started. The controller may compare one or both sensed parameters to one or two threshold values and log the time at which the sensed parameter exceeds the respective threshold value. The threshold value for the pressure may be determined based on the hydrostatic pressure for the depth at which the downhole tool is located. The threshold value for the flow rate may be determined as a minimum flow rate. The detection of both the pressure of the treatment fluid and the rotation of the drill string allows a simpler and less complex activation process compared to the downhole link systems using mud or flow pulses.

The pressure may be sensed by using a pressure sensor, and the flow rate may be sensed by using a flow sensor as described above. One or more vibration or rotation sensors are arranged relative to the drill string and configured to sense the rotation of the drill string. The rotation sensor may be an accelerometer, a gyroscope or another suitable sensor configured to detect the angular movement of the drill string.

According to one embodiment, the controller further determines which of the two starting times were logged first.

This allows the activation method to selectively activate a desired operation mode of a downhole tool or selectively activating a downhole tool amongst a group of downhole tools. The downhole tool may comprise multiple operation modes as described above. In this configuration, the controller determines whether the pumping was started before the rotation, e.g., the first starting time is before the second starting time, or vice versa. If the pumping was started before the rotation, the controller activates a first operation mode or downhole tool. If the rotation was started before the pumping, the controller activates a second operation mode or downhole tool.

The activation mechanism may enter the standby mode once the downhole tool or operation mode is activated, thus reducing the power consumption. The activation mechanism may enter the normal mode when at least one of the two parameters has been detected or logged.

This configuration may be combined with the activation method described earlier for increasing the functionality of the activation mechanism. The activation mechanism may then be programmed to activate one or more desired activation tools.

An object of the invention is finally achieved by an activation mechanism characterised in that:

the activation mechanism is configured to carry out the activation method as mentioned above.

This provides a standalone activation mechanism that allows for a fast and accurate activation of the downhole tool without the use of any activation balls or RFID tags. This configuration allows the downhole tool to be activated by simply monitoring the pressure and/or the flow rate of the treatment fluid being pumped through the drill string over at least one time window. This configuration provides a simpler and less complex activation process compared to the downhole link systems using mud pulses. The present invention is particularly suitable for, but not limited to, measure-while-drilling (MWD), logging-while-drilling (LWD) and rotary steerable system (RSS) applications.

The pressure sensor may be a transducer, a piezometer or another suitable sensor arranged relative to the internal flow path or paths of the treatment fluid passing through the downhole tool. The flow sensor may be a flow meter or another suitable sensor arranged relative to the internal flow path or paths of the treatment fluid passing through the downhole tool. The controller may be connected to both a pressure sensor and a flow sensor for increasing the functionality of the activation mechanism. The functionality may be further increased by connecting a vibration or rotation sensor to the controller. The controller may then be programmed according to the selected activation method and the selected time periods and threshold values thereof. The components of the electronic system may be selected so that the operating temperature range falls within the operating temperature range of the downhole tools.

The activation mechanism may comprise any suitable means for activating the downhole tool or a part thereof. The controller may be connected to a wired or wireless connection for activating the downhole tool electronically. The controller may be connected to a mechanical or hydraulic arrangement for activating the downhole tool where the mechanical or hydraulic arrangement is activated and controlled by the controller. This allows the connection means of the activation mechanism to be adapted to the configuration of a selected type of downhole tool. Another activation mechanism may then be connected to another downhole tool for selectively activating that tool.

According to one embodiment, the means for activating the downhole tool is at least one moveable element having at least one contact surface for contacting a matching contact surface on at least a first and second downhole tool.

This provides an activation element capable of mechanically activating more than one downhole tool. The activation element may be configured as at least one moveable element, e.g., an arm or pod, configured to engage at least one matching element, e.g., a receiving cavity or insert. The moveable element may be arranged to be moved in a radial direction relative to the longitudinal (axial) direction of the body of the activation mechanism or rotated in a clockwise or anti-clockwise direction around a rotation point located in the body. This allows for a simple and easy activation of the downhole tool.

The activation element may further comprise one or more sub-elements configured to alter the size (e.g., the diameter) or shape of the moveable element. The sub-elements may alternatively or additionally be configured to alter the position of the moveable element relative to the body. This allows the activation element to be adapted to the size and shape of various downhole tools as well as downhole tools from different manufactures.

In this configuration, the activation mechanism may be lowered to the first downhole tool and the pumps are started. The controller may monitor the pressure and/or flow rate of the fluid and activate the downhole tool and/or selected mode, as described above. Once the first downhole tool has been activated, the pumping is stopped or at least changed to a different level. The activation mechanism may then be moved to a second downhole tool. The pumps may then be re-started if they have been stopped. The controller may then monitor the pressure and/or flow rate of the fluid and activate the downhole tool and/or selected mode, as described above. The process is repeated until all the desired downhole tools have been activated.

The invention is described by example only and with reference to the accompanying drawings.

DETAILED DESCRIPTION OF THE INVENTION

In the following text, the figures will be described one by one and the different parts and positions seen in the figures will be numbered with the same numbers in the different figures. Not all parts and positions indicated in a specific figure will necessarily be discussed together with that figure.

Figure 1:
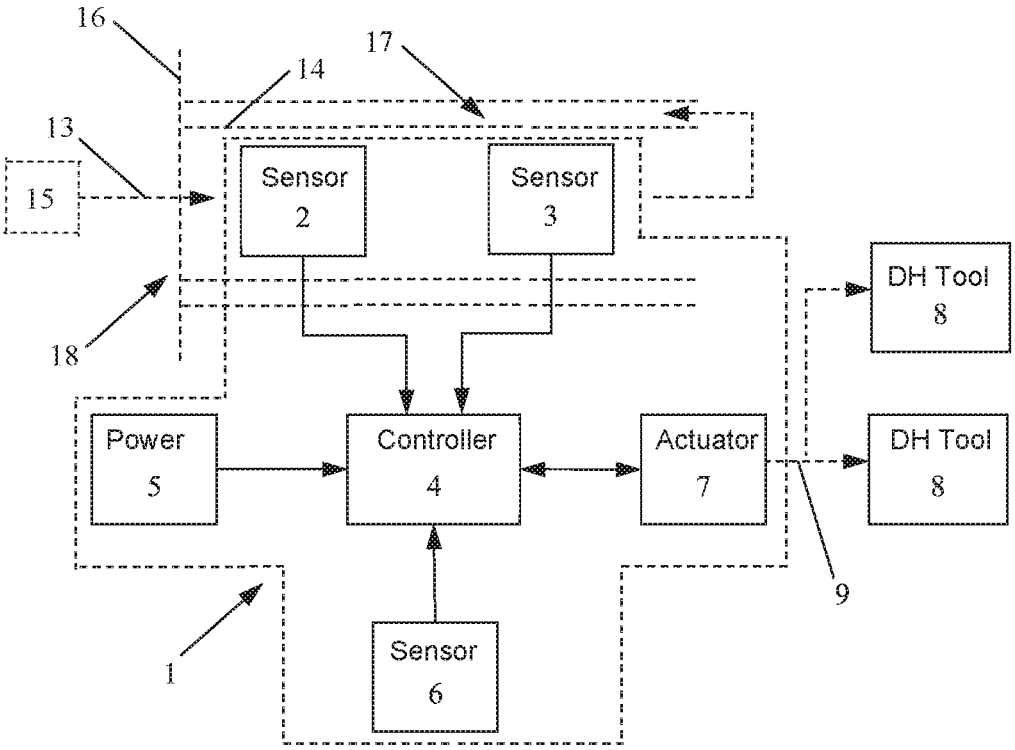
FIG. 1 is a block diagram of an activation mechanism according to the present invention.

FIG. 1 shows an exemplary embodiment of the downhole activation mechanism 1 according to the present invention. The downhole activation mechanism 1 comprises at least one pressure sensor 2 and/or at least one flow sensor 3. The two sensors 2, 3 are connected to a controller 4 configured to log the sensed signals and analyse the sensed signals. The pressure sensor 2 is arranged relative to the internal fluid path of the treatment fluid 13 in a drill string 14. Only a section of the drill string 14 is shown here. The treatment fluid 13 is pumped through the drill string 14 via a pump system 15 located at the surface level 16 and circulated back up through the annulus 17 between the drill string 14 and the sidewall of the borehole 18. The pressure sensor 2 measures the internal pressure of the treatment fluid. The flow sensor 3 is also arranged relative to the fluid path of the treatment fluid being pumped through the drill string. The flow sensor 3 measures the internal flow rate of the treatment fluid.

The downhole activation mechanism 1 comprises a power source unit 5 in the form of a battery unit. The battery unit 5 powers the electronic components of the downhole activation mechanism 1.

An internal clock is connected to the controller 4 and is used to supply a timing signal to the controller 4 for logging the sensed signals from the sensors 2, 3. The clock signal is also used to define the processing speed of the controller 4.

In one embodiment, the controller 4 is configured to log a first time tP of starting the pumping procedure, e.g. switching the pump system 15 on. The controller 4 is configured to further log a second time tR of starting the rotation of the drill string 14. At least one rotation sensor 6 in the form of an accelerometer is connected to the controller 4. The rotation sensor 6 is arranged relative to the drill string 14 for measuring the angular rotating movement of the drill string 14. The sensed signal is logged in the controller 4 which uses this signal to determine the second starting time tR. The sensed signal from the pressure sensor 2 and/or the rotation sensor 6 is compared to a threshold value for determining the starting times tP, tR.

One or more moveable elements 7 in the form of an arm having at least a contact surface for contacting a matching contact surface of one or more downhole tool 8 arranged in the downhole activation mechanism 1. The operation of the moveable elements 7 is controlled by the controller 4, e.g., by means of a hydraulic actuator (not shown). The moveable element 7 acts as an activation element that communicates with a corresponding activating element on the downhole tool 8 for activating 9 the downhole tool 8. Here, the moveable element 7 is configured to engage a matching cavity in the downhole tool 8 which acts as the corresponding activating element. This enables the downhole activation mechanism to be arranged as a standalone unit capable of activating multiple downhole tools 8, e.g., of different types and from different manufactures.

Figure 2:
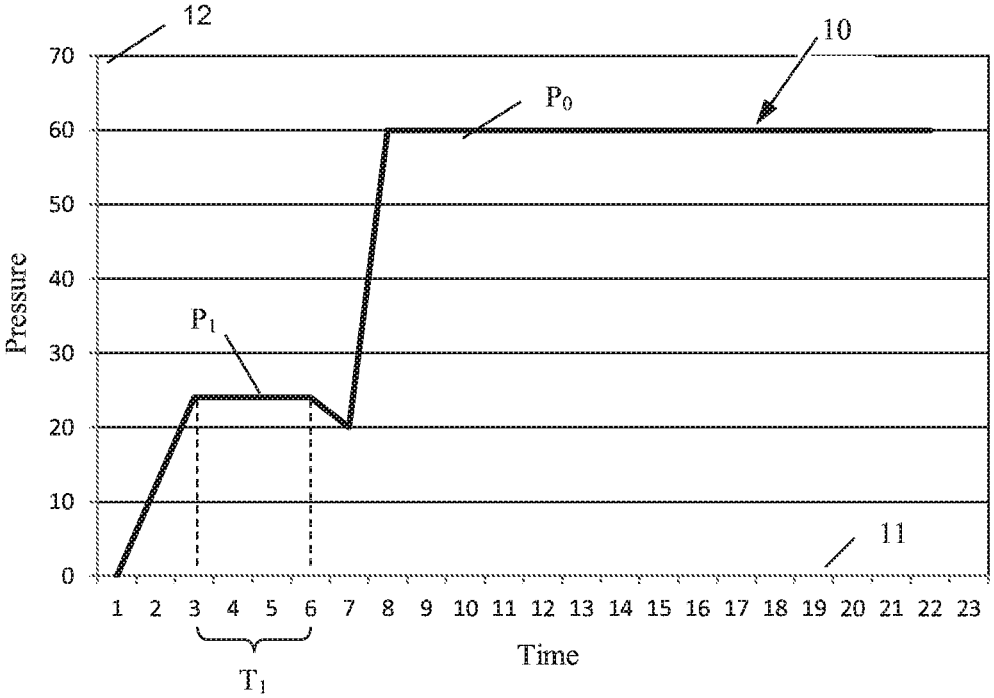
FIG. 2 is a graph that represents a first example of an activation method according to the present invention.

FIG. 2 shows a first example of an activation method according to the present invention implemented in the downhole activation mechanism of FIG. 1. The graph 10 shows the internal pressure measured by the pressure sensor 2. The x-axis 11 indicates the time, here shown in minutes, while the y-axis 12 indicates the measured pressure, here shown in bar.

The controller 4 applies any number of time windows T, e.g., one, two, three or more, to the measured pressure 10. The controller 4 compares the pressure 10 to any number, e.g., one, two, three or more, of predetermined threshold values (marked by $P_1$) each of which defines an activation level for a selected downhole tool 8. In this embodiment, the controller 4 starts a first time window $T_1$ when the measured pressure 10 reaches the threshold value $P_1$. The controller 4 monitors the pressure within the time window $T_1$ and determines if the measured pressure 10 remains stable throughout the time window $T_1$ or not. If the measured pressure is stable, then the controller 4 activates the selected downhole tool 8, e.g., by means of the moveable element 7.

The pressure 10 of the treatment fluid is then increased by means of the external pump system 15 to the desired operating level (marked by P0). The activation mechanism 1 finally enters a standby mode in which the power consumption is reduced to a minimum.

Figure 3:
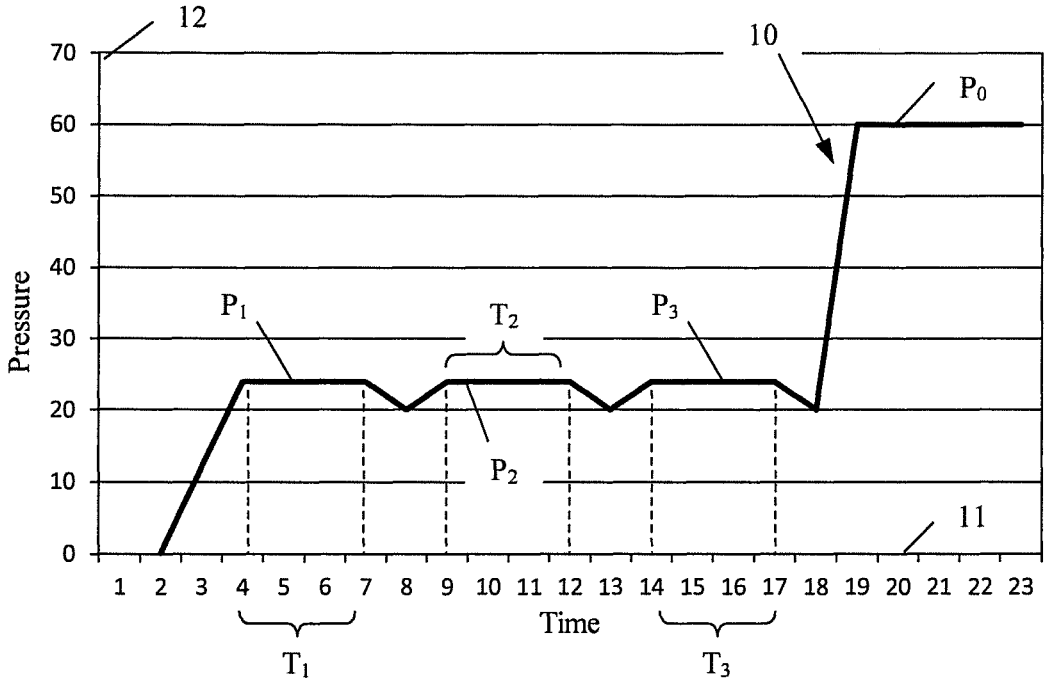
FIG. 3 is a graph that represents a second example of the activation method.

FIG. 3 shows a second example of the activation method in which the downhole tool 8 is operated according to any number of operation modes, e.g., at least two, three or more. This activation method also enables the controller 4 to selectively activate a desired downhole tool 8 within a plurality of downhole tools 8, e.g., at least two, three or more. In this embodiment, each of the downhole tools 8 has the same activation level (marked by $P_1$, $P_2$, $P_3$).

Once the measured pressure 10 reaches the desired activation level $P_1$, the controller 4 determines if the pressure 10 remains stable within a first time window $T_1$, as described in FIG. 2.

The controller 4 then monitors the measured pressure 10 within a second time window $T_2$ and determines if the pressure 10 remains stable or not. If the measured pressure 10 is stable, then the controller 4 activates a second downhole tool 8, e.g., by means of the moveable element 7. After activating the second downhole tool 8, the controller 4 monitors the measured pressure 10 within a third time window $T_3$ and determines if the pressure 10 remains stable or not. If the measured pressure 10 is stable, then the controller 4 activates a third downhole tool 8, e.g., by means of the moveable element 7, and so forth. This allows the downhole tools 8 or operation modes to be activated in a sequential order.

The controller 4 may start the second, third or another subsequent time window $T_2$, $T_3$ once the pump system has compensated for the activation of the previous downhole tool 8 or operation mode, e.g., the measured pressure 10 reaches the desired activation level again.

Figure 4A:
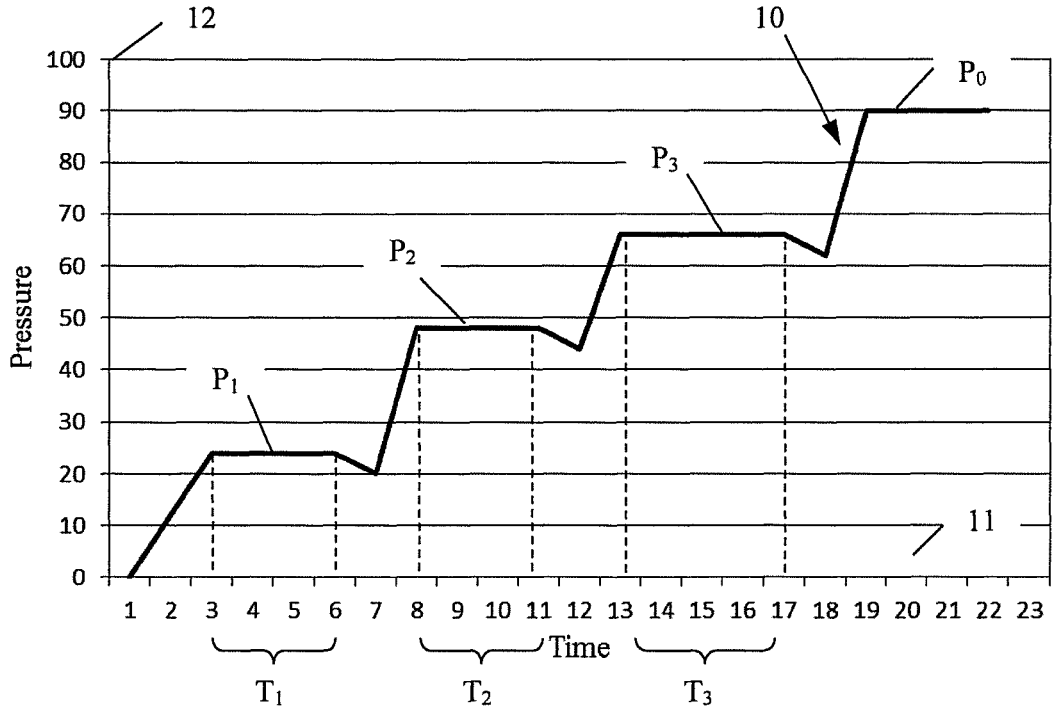
FIGS. 4*a* & 4*b* are graphs that represent a third example of the activation method.
Figure 4B:
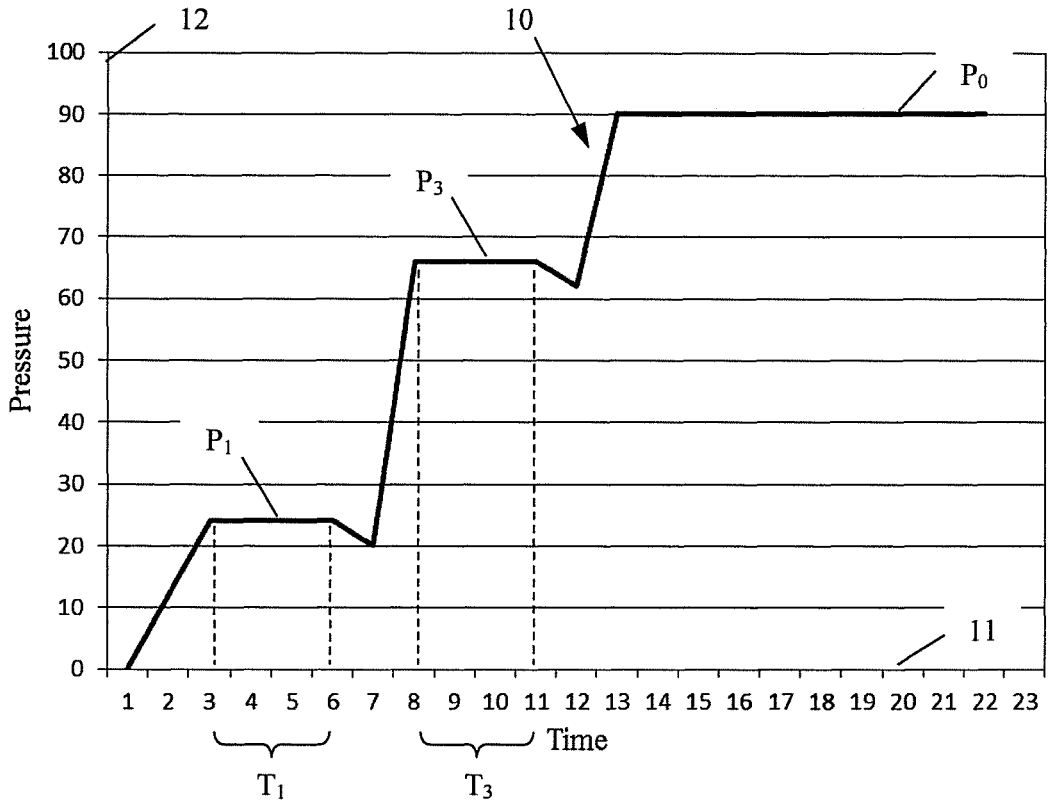

FIGS. 4*a* & 4*bb* show a third exemplary of the activation method which differs from the method of FIG. 3 by the downhole tools 8 having different activation levels $P_1$, $P_2$, and $P_3$. The activation levels $P_2$, $P_3$ of the second and third downhole tools 8 or the operation modes are in this embodiment located between the first activation level $P_1$ and the operating level $P_0$.

The controller 4 starts the second, third or another subsequent time window $T_2$, $T_3$ once the measured pressure 10 reaches the desired activation level $P_2$, $P_3$ for next downhole tool 8 or operation mode. This allows any one of the downhole tools 8 or operation modes to be activated by passing one or more activation levels, as shown in FIG. 4*b*.

Depending on which operation mode or downhole tool 8 that should be activated, the pump system may continue to increase the measured pressure 10 past any one of the activation levels $P_1$, $P_2$, $P_3$.

As shown in FIG. 4*b*, the pump system continues to increase the pressure 10 past the activation level $P_2$ for the second downhole tool 8 or operation mode. The controller 4 determines that the measured pressure 10 is not stable, e.g., exceeds the upper threshold limit, within the second time window $T_2$, thus the controller 4 does not activate the second downhole tool 8 or operation mode.

Figure 5A:
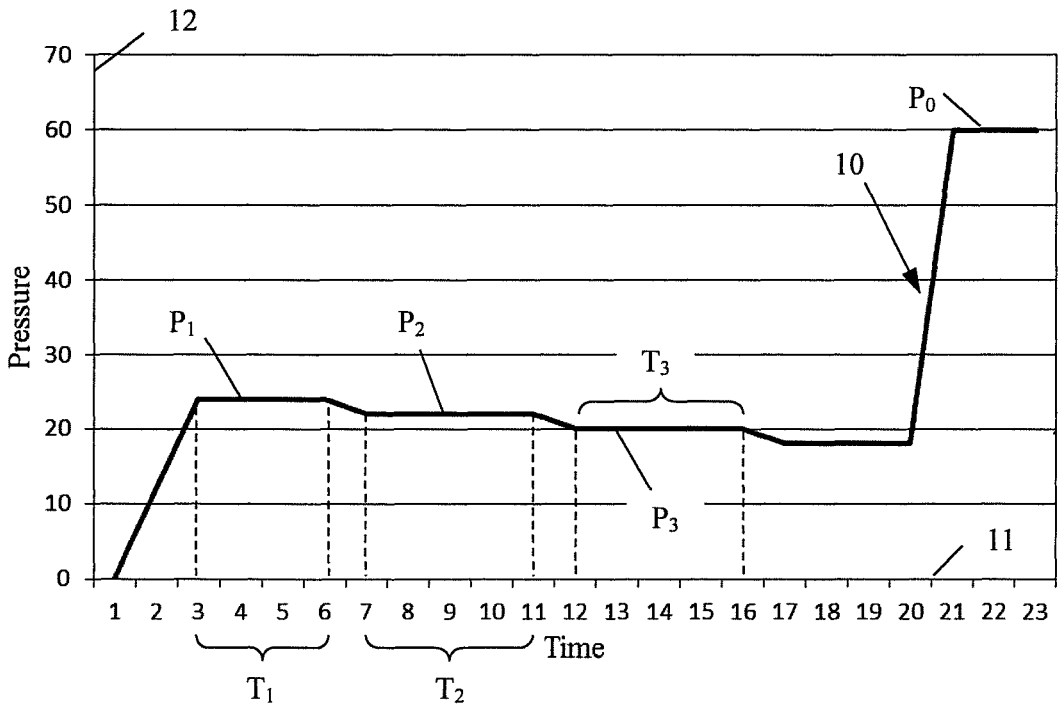
FIGS. 5*a* & 5*b* are graphs that represent a fourth example of the activation method.
Figure 5B:
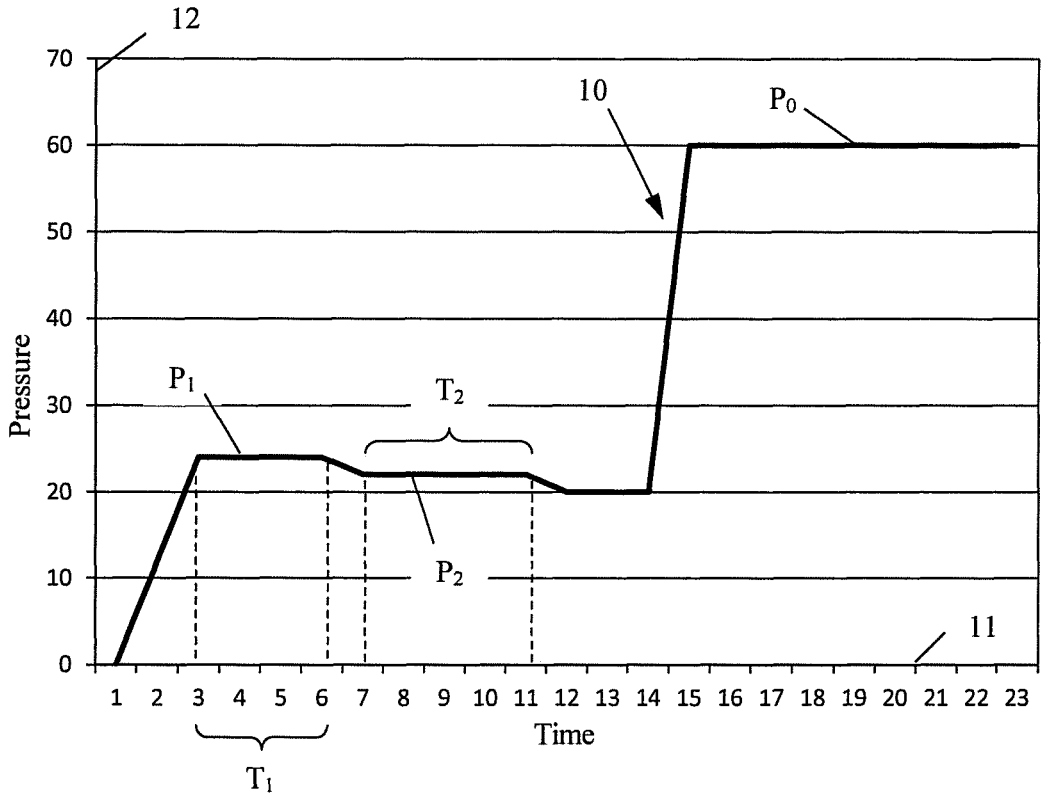

FIGS. 5*a* & 5*bb* show a fourth example of the activation method which differs from the method of FIG. 3 by the downhole tools 8 having different activation levels $P_1$, $P_2$, $P_3$. The activation levels $P_2$, $P_3$ of the second and third downhole tools 8 or operation modes are in this embodiment located between the first activation level $P_1$ and a pressure of null.

In this embodiment, the temporary pressure drop occurring after activation of the previous downhole tool 8 or operation mode is used to change the pressure 10 from one activation level to another activation level. The controller 4 starts monitoring the measured pressure 10 within the second time window $T_2$ when the pressure reduced to the activation level $P_2$ for the second downhole tool 8 or operation mode. If the controller 4 determines that the measured pressure 10 is stable within the second time window $T_2$, then the second downhole tool 8 or operation mode is activated. The controller 4 starts monitoring the measured pressure 10 within the third time window $T_3$ when the pressure is further reduced to the activation level $P_3$ for the third downhole tool 8 or operation mode. If the controller 4 determines that the measured pressure 10 is stable within the third time window $T_3$, then the third downhole tool 8 or operation mode is activated.

Once the desired downhole tool 8 or operation mode has been activated by the controller 4, the pump system continue to increase the pressure of the treatment fluid past the first activation level $P_1$ until it reaches the operating level $P_0$. The controller 4 determines that the measured pressure 10 is not stable, e.g., exceeds the upper threshold limit, within the succeeding time window $T_3$, thus the controller 4 does not activate the succeeding downhole tool 8 or operation mode. This allows any one of the downhole tools 8 or operation modes to be activated by passing one or more activation levels.

What is claimed is:

1. A method for activating at least one downhole tool of a drill string located in a borehole while using a downhole activation mechanism arranged in the drill string, the method comprising:

using at least one sensor to sense at least one first parameter of a drilling fluid being pumped through the drill string via an external pump system and circulated back up through the annulus between the drill string and a sidewall of the borehole;

applying at least a first time window to a sensed signal from the at least one sensor and analyzing the sensed signal in a controller of the downhole activation mechanism; wherein the method further comprises the steps of:

sensing at least a second parameter using at least a second sensor, wherein the second parameter is a rotation of the drill string;

using the controller to monitor the at least one first parameter and the second parameter;

activating at least a first downhole tool or first operation mode and/or a second downhole tool or second operation mode by activating one or more activation elements located in the activation mechanism; communicating the one or more activation elements with corresponding activating elements arranged on at least the first or second downhole tool; wherein the first downhole tool performs at least a first mode of operation upon activation;

wherein the controller compares the second parameter to a threshold value and further monitors the at least one first parameter within the first time window and determines whether or not the at least one first parameter remains stable relative to least a first threshold value, and if the at least one first parameter is stable within the first time window, then the first downhole tool is activated;

wherein after a selected downhole tool or operation mode is activated, the at least one first parameter is increased to a predetermined operating level, and wherein said at least first threshold value is between 10 to 90% of an operating flow rate with the operating flow rate being between 1.000 to 1.500 L/min.

2. The method according to claim 1, wherein at least a second time window is applied to the sensed signal of the at least one first parameter prior to increasing the at least one first parameter to the predetermined operating level, and the controller further monitors the at least one first parameter within the second time window and determines whether or not the at least one first parameter remains stable relative to a second threshold value.

3. The method according to claim 2, wherein the second downhole tool or second operation mode of the first downhole tool is activated if the at least one first parameter is stable within the second time window.

4. The method according to claim 3, wherein the at least one first parameter, when stable, remains within upper and lower limits of a threshold band located around the first or second threshold value, wherein the second threshold value is the same as or differs from the first threshold value.

5. The method according to claim 1, wherein the downhole activation mechanism comprises at least one battery unit, wherein the at least one battery unit drives electronic components of the downhole activation mechanism used to activate at least the first downhole tool.

6. The method according to claim 1, wherein the at least one first parameter is a pressure or a flow rate of the drilling fluid pumped through the drilling string.

7. The method according to claim 1, wherein the controller further comprises determining a first starting time for the at least one first parameter and a second starting time for the at least one second parameter.

8. The method according to claim 7, wherein the controller further comprises determining which of the two starting times was logged first.

9. A downhole activation mechanism for activating one or more downhole tools of a drill string located in a borehole, comprising:

at least one first sensor configured to sense at least one first parameter of a drilling fluid being pumped through the drill string via an external pump system and circulated back up through an annulus between the drill string and a sidewall of the borehole;

at least one second sensor configured to sense at least one second parameter, wherein the at least one second parameter is a rotation of the drill string;

a controller connected to the at least one first and second sensors and configured to analyze the sensed signals of the at least one first and second sensors, wherein the controller is configured to apply at least one predetermined time window to the sensed signal related to the at least one first parameter;

one or more activation elements located in the downhole activation mechanism, the one or more activation elements being configured for communication with corresponding activating elements arranged on the one or more downhole tools;

wherein upon activation of the one or more downhole tools by the activation elements, the one or more downhole tools are configured to perform at least one mode of operation, wherein the controller of the downhole activation mechanism is configured to monitor the at least one first parameter within a first time window and to determine whether or not the at least one first parameter remains stable, and to compare the second parameter to a threshold value, wherein said at least first threshold value is between 10 to 90% of an operating flow rate with the operating flow rate being between 1.000 to 1.500 L/min, wherein the controller is further configured to activate:

at least one of the one or more downhole tools, if the at least one first parameter is stable within the first time window, and/or;

at least one operation mode of the one or more downhole tools, if the at least one first parameter is stable within the first time window;

wherein the controller is adapted to increase the at least one first parameter to a predetermined operating level after a selected operation mode or downhole tool is activated.

10. The activation mechanism according to claim 9, wherein, upon activation of the one or more downhole tools, the controller is further configured to determine a first starting time for the at least one first parameter and a second starting time for the at least one second parameter.

* * * * *